United States Patent [19]

Carroll

[11] Patent Number: 5,061,823

[45] Date of Patent: Oct. 29, 1991

[54] CRUSH-RESISTANT COAXIAL TRANSMISSION LINE

[75] Inventor: Charles E. Carroll, Landenberg, Pa.

[73] Assignee: W. L. Gore & Associates, Inc., Newark, Del.

[21] Appl. No.: 553,200

[22] Filed: Jul. 13, 1990

[51] Int. Cl.[5] ..... H01B 7/22

[52] U.S. Cl. ..... 174/105 R; 174/106 R; 174/107; 174/108; 174/109

[58] Field of Search ..... 174/105 R, 106 R, 107, 174/108, 109

[56] References Cited

U.S. PATENT DOCUMENTS

| | | | |
|---|---|---|---|
| 2,003,990 | 6/1935 | Carlson et al. | 174/106 R |
| 2,004,004 | 6/1935 | Knoderer | 174/106 R |
| 2,028,793 | 1/1936 | Mascuch | 174/109 |
| 2,133,863 | 10/1938 | Knoderer | 174/106 R |
| 2,287,947 | 6/1942 | Shoemaker | 174/107 |
| 3,355,544 | 11/1967 | Costley et al. | 174/106 R |
| 4,408,089 | 10/1983 | Nixon | 174/34 |
| 4,626,810 | 12/1986 | Nixon | 333/243 |
| 4,642,417 | 2/1987 | Ruthrof et al. | 174/36 |
| 4,719,320 | 1/1988 | Strait, Jr. | 174/106 R |
| 4,731,502 | 3/1988 | Finamore | 174/74 R |
| 4,822,950 | 4/1989 | Schmitt | 174/36 |

FOREIGN PATENT DOCUMENTS

| | | | |
|---|---|---|---|
| 1363313 | 12/1987 | U.S.S.R. | 174/108 |
| 628781 | 9/1949 | United Kingdom | 174/105 R |

*Primary Examiner*—Morris H. Nimmo

*Attorney, Agent, or Firm*—Gary A. Samuels

[57] ABSTRACT

A crush, kink, and torque resistant, flexible coaxial cable having a closely spaced, spiralled rigid metal wire layer between the outer conductor of the coaxial transmission line and the outer jacket of the cable. Small size light weight, good flexibility with minimum spring-back and excellent crush resistance are provided together with excellent kinking, and torque resistance. This eliminates the need for external ruggedization to protect the electrical properties of the cable.

11 Claims, 4 Drawing Sheets

CRUSH-RESISTANT COAXIAL TRANSMISSION LINE

FIELD OF THE INVENTION

The invention pertains to a small-diameter, light weight coaxial electrical cable having internal crush, torque and kinking resistance.

BACKGROUND OF THE INVENTION

Flexible coaxial cables are frequently used as transmission lines for radio frequency, microwave frequency, and millimeter wave frequency electromagnetic waves. These high frequency waves are capable of carrying many signals simultaneously. Physical maintenance of the signal path is critical to transmitting the signals from one point to another without distortion (return loss) or attenuation (signal loss). The flexible coaxial cables used have an inner conductor of diameter "d" and an outer conductor (shield) of diameter "D". The inner conductor is typically stranded or solid wire and the outer conductor is typically braided metal wire, helically wrapped metal foil, helically-wrapped round wire, or helically wrapped metal-plated or metal-coated polymer. The ratio of the diameter of the inner and outer conductors and the dielectric constant of the material separating them determines cable impedance and must be maintained within tight tolerances. Any distortions due to denting, crushing, or otherwise introducing a non-concentric relationship will result in higher distortion (return loss) and higher attenuation (signal loss). Also, if the integrity of the outer conductor (shield) is interrupted, energy will escape. Torsional (twisting) force can cause the outer conductor to open resulting in an interrupted signal path. The types of damage (denting, crushing, kinking, twisting) described often occur during installation and use due to the cable being bent over sharp objects, clamped too tightly, struck by another object, twisted, or bent beyond its minimum bend radius.

These types of damage are more likely in flexible cables that use air-spaced dielectric materials, but can also occur in cables using solid dielectrics.

In the past, two main approaches have been used to protect cables from crushing and torsional damage. The first is extra layers over the shield of the cable such as braided wires and/or hard-film wraps such as Kapton® polyimide and thicker external jackets. These tend to be very stiff. The second approach is the use of external means of providing added protection in the form of flexible conduits. Typical examples would be springs covered with extruded polymers or shrink tubes and flexible metal conduits (armors). The external conduit or ruggedizations such as shown in U.S. Pat. No. 4,731,502, while adding significant crush and/or torque resistance, add significantly to the weight and diameter of the cable.

SUMMARY OF THE INVENTION

This employs an internal mechanical means for greatly increasing the crush, kinking, and torque resistance of a coaxial transmission line. The transmission line of the invention comprises a coaxial transmission line having a closely-spaced spirally wrapped rigid wire over the outer conductor of the transmission line and under the polymeric protective outer jacket of the line. This provides crush and kinking resistance. The addition of a braided wire, fiber, or tape layer over the spirally wrapped rigid wire provides torque resistance as well. An extruded or tape-wrapped polymer separator layer may be utilized to separate the outer conductor of the line from the spirally-wrapped rigid wire or between the rigid wire and a layer of mechanical braid to provide flexibility to the cable.

The coaxial cable of the invention provides considerable crush, kinking, and torque resistance. As a result, the electrical performance of the transmission line is maintained under harsher environments of installation and use and the useful life of the transmission line is greatly extended. These improvements are provided while maintaining a high degree of flexibility and minimum spring-back in the cable. The diameter and weight of the cable is considerably less than that obtained by external means of protection.

DESCRIPTION OF THE INVENTION

Figure 1:
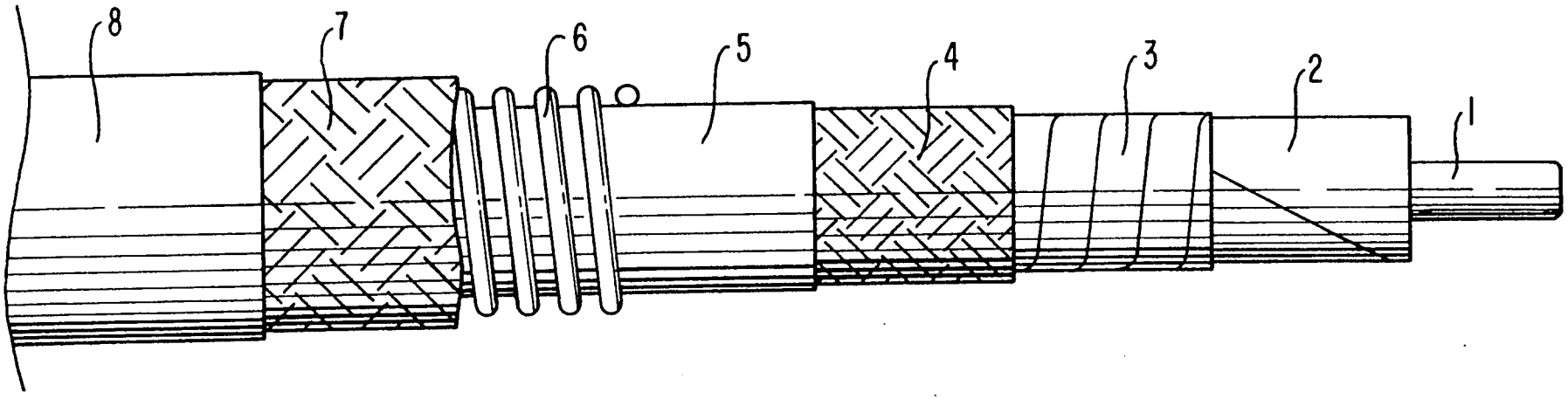
FIG. 1 is a side view of a cable of the invention with the layers cut away for display.

The cable of the invention is described now with reference to the drawings to more carefully and completely delineate the invention. The invention provides a coaxial cable in which a strong, rigid wire 6 is closely spiralled at a relatively steep angle of lay, such as 45° or greater from the axis of the cable, preferably 60° or greater around the coaxial transmission line, outside of the outer conductor 3 or shield of the basic coaxial transmission line, but inside a protective plastic outer jacket 8. One or more layers of mechanical braid 4 or 7 of metal or strong polymer fiber are applied either or both inside and/or outside the spiralled rigid wire 6, over the coaxial transmission line, but inside the outer protective polymer jacket 8. A plastic separator 5 may optionally be applied between spiral wire 6 and mechanical braid 4 or outer conductor 3 of the coaxial transmission line. Separator 5 aids in movement of the layers and flexibility of the over-all cable when it is flexed or bent in installation or use.

FIG. 1 describes a side view of a cable of the invention with the layers partially removed for easy viewing of the internal structure of the cable. Center conductor 1 of the transmission line is an electrically conductive metal signal-transmitting wire covered with at least one layer of electric insulating material 2 which may be extruded onto conductor 1 or spirally or helically wrapped about conductor 1 if a plastic tape is used for insulation 2. An outer electrical conductor 3 is placed about insulation 2 by methods and processes well-known in the art for that purpose. A mechanical braid 4 is next braided around the basic coaxial signal transmission line described above. Braid 4 may be formed from round or flat metal wire or tape or a strong plastic fiber. Over braid 4 is extruded or helically or spirally wrapped a plastic separator 5, which lies under and separates from braid 4 a layer 6 of rigid closely-spaced spirally or helically wrapped wire at a relatively steep angle (45°–65° or greater to the cable axis) with the coils thereof close together but separated from each other.

The spacing of the coils may be varied from being in contact to being separated to provide greater crush resistance or greater flexibility. At least a small space between the coils is preferred for flexibility while retaining maximum crush resistance. Placing the spiral wires close together provides a bend radius limiting mechanism, i.e. resists kinking. Layer 6 of rigid wire provides excellent crush resistance to the transmission line. Next comes a layer 7 of tightly woven mechanical braid of the same or similar alternative materials to braid 4. This adds torque resistance to the transmission line. The cable is completed by applying a protective plastic outer jacket 8 onto it by extrusion or tape wrapping, for example.

As to the materials found useful in manufacture of the transmission line of the invention, center conductor 1 preferably comprises a copper, silver-plated copper, or silver-plated copper-clad steel wire. Insulating or dielectric material 2 is preferably porous or solid polytetrafluoroethylene (PTFE), polyethylene, or fluorinated ethylene-propylene copolymer (FEP). Outer conductor 3 of the basic coaxial cable is a material containing electrically conductive metal, such as for example round or flat wire braid, helically or spirally wrapped metal-coated polymer tape layers, helically wrapped metal foil, and served metal wire. The round wire braid is preferably made of silver-plated copper or silver-plated copper-clad steel wire. A flat wire braid is preferably formed from silver-plated copper tape. An aluminized polyimide tape, such as Kapton ® tape, or polyester tape, such as Mylar ® is preferred for a helically wrapped metallized polymer tape. Optional mechanical braid 4 is preferably formed from silver-plated copper, silver-plated copper-clad stainless steel, or stainless steel wires or strands or from strong aromatic polyamide plastic fibers or strands, such as for example Nomex ® or Kevlar ® fiber.

The optional separator 5 is a plastic sheath, either extruded or tape-wrapped around either outer conductor 3 or mechanical braid 4, but under spiral wire 6. Useful materials for separator 5 include extruded PTFE, FEP, silicone, polyethylene and polyperfluoroalkoxy tetrafluoroethylene (PFA), and tape-wrapped porous PTFE tape, polyester tape, and polyimide tapes, for example.

Rigid Spiral wire 6, which serves to ruggedize the transmission line by increasing the crush and torque resistance (in one direction) of the line and increasing the resistance to kinking, is preferably made of stainless steel, phosphor bronze, silver-plated copper-clad steel, or similar hard materials. Wire 6 may be a single end of wire or a group of parallel wires. Wire 6 is applied at a relatively steep angle of lay in closely spaced spirals to maximize crush resistance and resistance to kinking.

To control the effects of torque on the transmission line, a layer of mechanical braid 7 is braided over hard wire spiral 6. The materials useful for this braid are the same as those listed above for braid 4.

To protect the transmission line from the environment, an outer jacket 8 surrounds braid 7 or spiral 6 to encase the line. Jacket 8 may be extruded over the cable or applied by other means and may be omitted. Suitable materials useful for jacket 8 include PTFE, FEP, PFA, polyvinyl chloride, and polyurethane, for example. Separator layer 5 may also be used to provide environmental protection to the transmission line.

Figure 2:
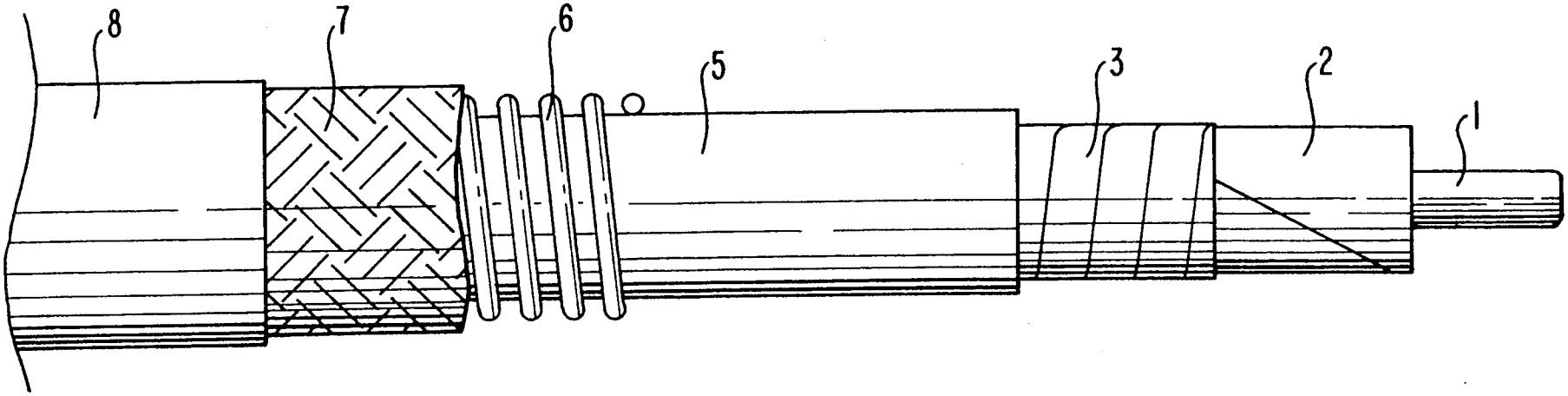
FIG. 2 is a peeled back side view of an alternative cable of the invention.

FIG. 2 shows a side view of an alternative embodiment of the cable of the invention wherein an optional mechanical braid 4 has not been included.

Figure 3:
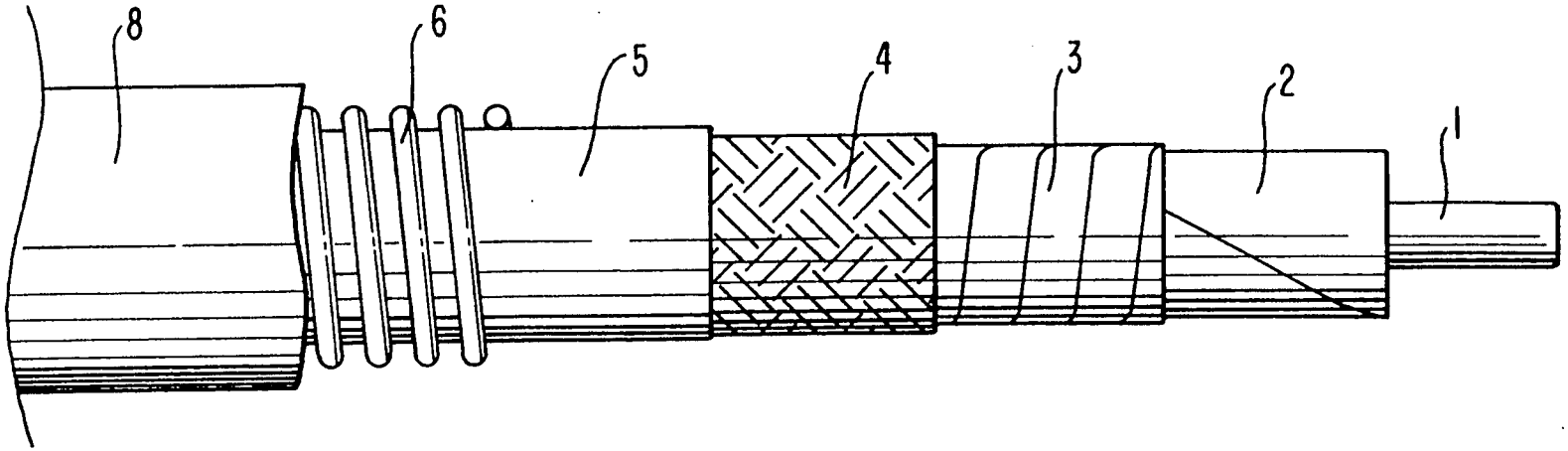
FIG. 3 is a peeled back side view of another alternative cable of the invention.

FIG. 3 describes a side view of another alternative embodiment of the cable in which there is no intervening mechanical braid 7 between spiral 6 and jacket 8.

Figure 4:
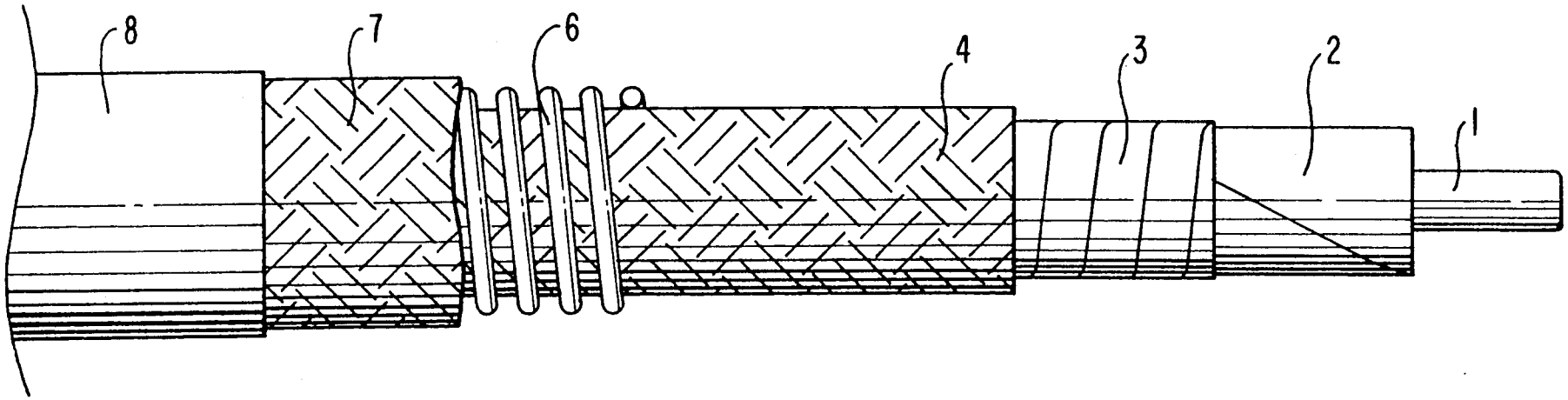
FIG. 4 is a peeled back side view of yet another alternative cable of the invention.

FIG. 4 depicts a side view of yet another alternate embodiment of the cable wherein an optional plastic separator 5 has not been included, but mechanical braids 4 and 7 have been applied on each side of rigid spiral wire 6.

The above materials and construction provide a transmission line having crush, kinking, and torque resistance (except FIG. 3). The cable remains curved when once bent (does not tend to spring back). The diameter of the cable is smaller than that attainable by external methods of ruggedization, the weight is equal or less, and a smaller bend radius is possible. The cable resists being bent to the point of kinking and retains its concentricity on bending better than non-ruggedized coaxial cables. The crush resistance is superior to other internal forms of ruggedization.

I claim:

1. A crush-resistant coaxial cable comprising:

(a) a coaxial transmission line, including in order an electrically conductive metal signal-transmitting center wire, at least one layer of electric insulating material, and at least one layer of material containing electrically conducting metal;

(b) a layer of rigid metal wire spiralled around said transmission line at a minimum angle of 45° to the axis of the cable; and (c) at least one layer of mechanical braid surrounding said transmission line which lies under said rigid metal wire spiral.

2. A cable of claim 1 including a protective outer plastic jacket.

3. A cable of claim 1 wherein said center conductor of said transmission line is selected from the group consisting of silver-plated copper, silver-plated copper-clad steel, and copper.

4. A cable of claim 1 wherein said electric insulating material is selected from the group consisting of solid or porous polytetrafluoroethylene, solid or porous polyethylene, and solid or porous fluorinated ethylene-propylene copolymer.

5. A cable of claim 1 wherein said material containing electrically conductive metal of said transmission line is selected from the group consisting of round wire braids, flat wire braids, helically-wrapped metal-coated polymer layers, helically-wrapped metal foil, and served metal wire.

6. A cable of claim 1 wherein said mechanical braid is selected from the group consisting of silver-plated copper, silver-plated copper clad steel, stainless steel, and aromatic polyamide plastic.

7. A cable of claim 1 wherein a plastic layer lies between and separates said mechanical braid and said rigid spiralled wire.

8. A cable of claim 7 wherein said plastic separator layer is selected from the group consisting of extruded polytetraluoroethylene, extruded fluorinated ethylene-propylene copolymer, extruded polyperfluoroalkoxy tetrafluoroethylene, extruded silicone, extruded polyethylene, helically-wrapped polyester tape, helically-wrapped polyimide tape, and helically wrapped polytetrafluoroethylene tape.

9. A cable of claim 2 wherein said protective plastic outer jacket is selected from the group consisting of extruded polytetrafluoroethylene, fluorinated ethylene-propylene copolymer, polyperfluoroalkoxy tetrafluoroethylene, polyvinyl chloride, and polyurethane.

10. A cable of claim 1 wherein said spiralled wire is selected from the group consisting of stainless steel, silver-plated copper-clad steel, and phosphor bronze.

11. A crush-resistant coaxial cable comprising:

(a) a coaxial transmission line, including in order an electrically conductive metal signal-transmitting center wire, at least one layer of electric insulating material, and at lest one layer of material containing electrically conducting metal;

(b) a layer of rigid metal wire spiralled around said transmission line at a minimum angle of 45° to the axis of the cable; and (c) at least two layers of mechanical braid surrounding said transmission line which lie both under and over said rigid metal spiral.

* * * * *